US005815859A

United States Patent [19]

Lavin

[11] Patent Number: 5,815,859

[45] **Date of Patent: *Oct. 6, 1998**

[54] LIFT STRAP

[76] Inventor: Manuel S. Lavin, P.O. Box 91, Belleville, Mich. 48111

[ * ] Notice: The term of this patent shall not extend beyond the expiration date of Pat. No. 5,685,033.

[21] Appl. No.: 806,956

[22] Filed: Feb. 26, 1997

Related U.S. Application Data

[63] Continuation-in-part of Ser. No. 595,195, Feb. 1, 1996, Pat. No. 5,685,033.

[51] Int. Cl.[6] ..... A61G 7/10

[52] U.S. Cl. ..... 5/89.1; 5/83.1

[58] Field of Search ..... 5/81.1 R, 81.1 T, 5/81.1 HS, 89.1, 83.1, 86.1, 87.1

[56] References Cited

U.S. PATENT DOCUMENTS

| | | | |
|---|---|---|---|
| 2,323,500 | 7/1943 | Trigg | 5/81.1 T |
| 2,523,891 | 9/1950 | Wallstrom | 5/89.1 X |
| 3,458,878 | 8/1969 | Combs | 5/81.1 T |
| 3,859,677 | 1/1975 | Nordwig | 5/89.1 |
| 4,221,011 | 9/1980 | Flinchbaugh | 5/89.1 |
| 4,536,903 | 8/1985 | Parker | 5/81.1 T |
| 5,530,976 | 7/1996 | Horcher | 5/81.1 T X |
| 5,579,546 | 12/1996 | Griskauskas | 5/81.1 T |
| 5,685,033 | 11/1997 | Lavin | 5/81.1 R |

FOREIGN PATENT DOCUMENTS

| | | | |
|---|---|---|---|
| 2 213 734 | 8/1989 | United Kingdom . | |
| 2213734 | 8/1989 | United Kingdom | 5/81.1 T |

*Primary Examiner*—Michael F. Trettel
*Attorney, Agent, or Firm*—Foley & Lardner

[57] ABSTRACT

The invention is directed to a method and apparatus for lifting a bedridden person using a lift strap device. The lift strap includes a main support member, a hook receiving member and a mechanism for securing the main support member to a portion of the person desired to be lifted. The mechanism for securing the person to the main support member includes a first strap member secured to one end of the main support member and a loop member fixed to an opposite end of the main support member. The main support member is secured to at least one leg of the person while the person is lying down on his/her back and is utilized to raise only the lower portion of the person from a support surface while permitting contact of the upper portion of the person with the support surface thereby permitting a care-giver to clean or change the person.

7 Claims, 3 Drawing Sheets

LIFT STRAP

CROSS REFERENCE TO RELATED APPLICATION

The instant application is a continuation-in-part of Ser. No. 08/595,195 filed Feb. 1,1996, now U.S. Pat. 5,685,033.

FIELD OF THE INVENTION

The invention is directed to a lift strap which may be utilized to lift a portion of a patient's body. The invention has application in hospitals, nursing homes, private homes, or any other environment which has bedridden persons requiring third party care as for example, elderly or paraplegic patients.

BACKGROUND OF THE INVENTION

Various straps have been disclosed in the prior art for moving or lifting a patient. Representative prior art patents include U.S. Pat. Nos. 2,323,500, 2,523,891, 3,458,878, 3,859,677, 4,536,903 and UK published patent application 2 213 734 A. The prior art devices do not permit a single care-giver to partial lift the patient so as to permit the patient to at least partially rest on the supporting bed while having the lower portion of the patient lifted off the bed to permit attending to the patients needs.

SUMMARY OF THE INVENTION

The invention may be characterized as a method for lifting a bedridden person by securing a main support member to at least one leg of the person while the person is lying down in a bed; securing each main support member to a lift bar of the lifting device; raising the lift bar of the lifting device so as to raise only the lower portion of the person from the bed thereby permitting a caretaker to clean or change the patient.

The invention may also be characterized as a lift strap for attachment to a leg of a patient desired to be lifted from a bed wherein the lift strap comprises a main support member, a hook receiving member and a securing device. The main support member is adapted for positioning above the patient's knee. The hook receiving member is secured to the main support member and projects away from the support member. The securing device is adapted to secure the main support member to the patient and includes a first strap member secured to one end of the main support member and a loop member fixed to an opposite end of the main support member.

DETAILED DESCRIPTION OF THE PREFERRED EMBODIMENTS

Figure 1:
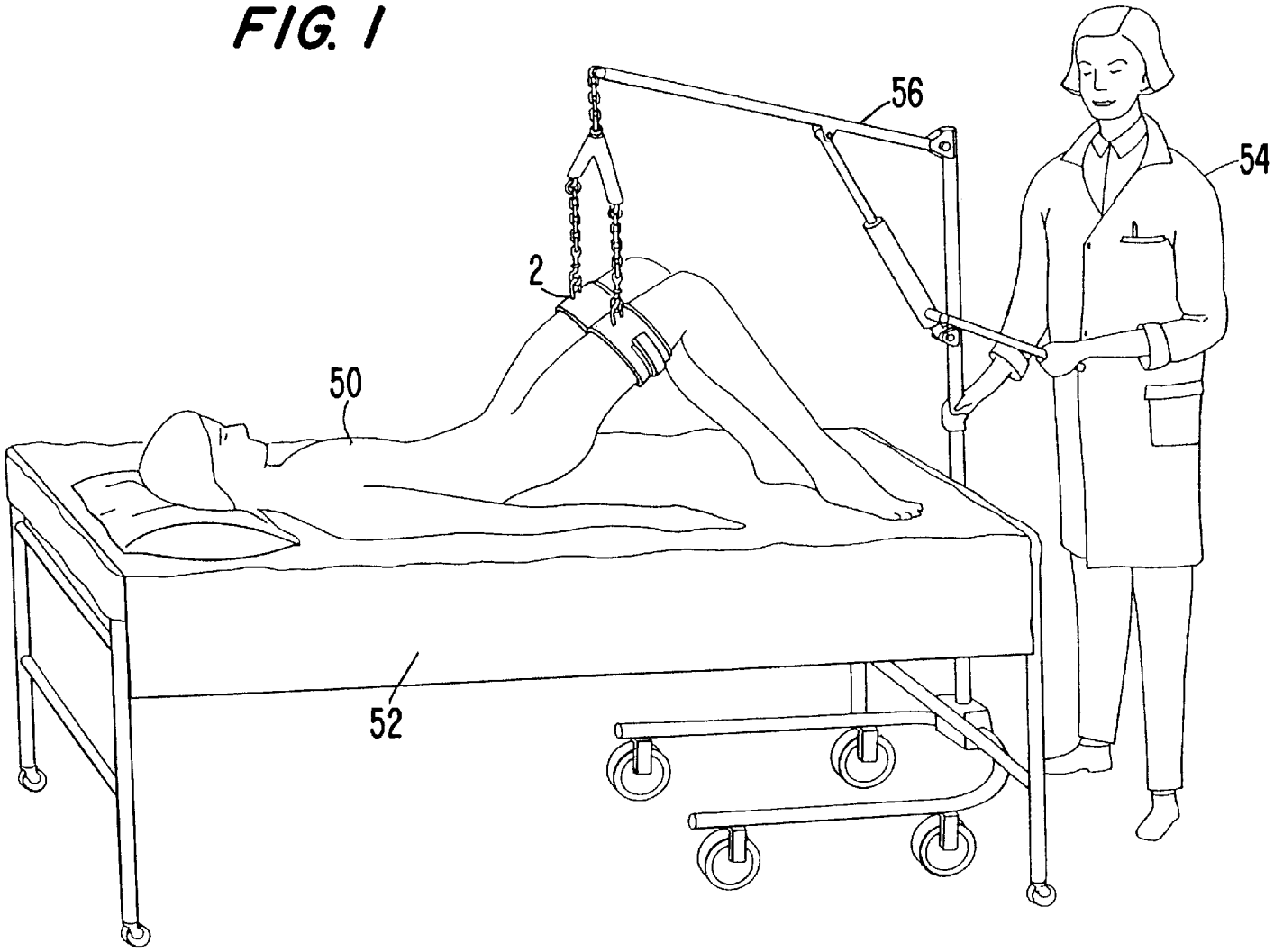
FIG. 1 shows a perspective view of the lift straps as attached to a patient and illustrates the method of lifting only the lower portion of the patient by a single care-giver.

In reference to FIG. 1, a patient 50 is shown lying on a bed 52 and being attended to by a care-giver 54. The care-giver 54 is shown lifting only the lower portion of the patient 50 in a manner comporting to the invention so as to attend to soiled clothing of the patient, remove and put on new undergarments, diapers and the like. The care-giver is shown using a lifter 54 connected to a pair of lift straps 2. Lift straps 2 are made in accordance with the invention and described in greater detail in relation to FIGS. 2–5.

The lifter 56 per se may be any of a number of commercially available lifters such as Hoyer Lifter Model C-HLA sold by Sunrise Medical of Simi Valley, Calif. Generally, a hydraulically assisted lifting device is preferred, although mechanically pulley arrangements and/or gear mechanisms giving a sufficient mechanical advantage to permit a single person to lift the lower portion of the patients body would also be sufficient. Electrically operated lifters, while more expensive would clearly also be sufficient.

Figure 2:
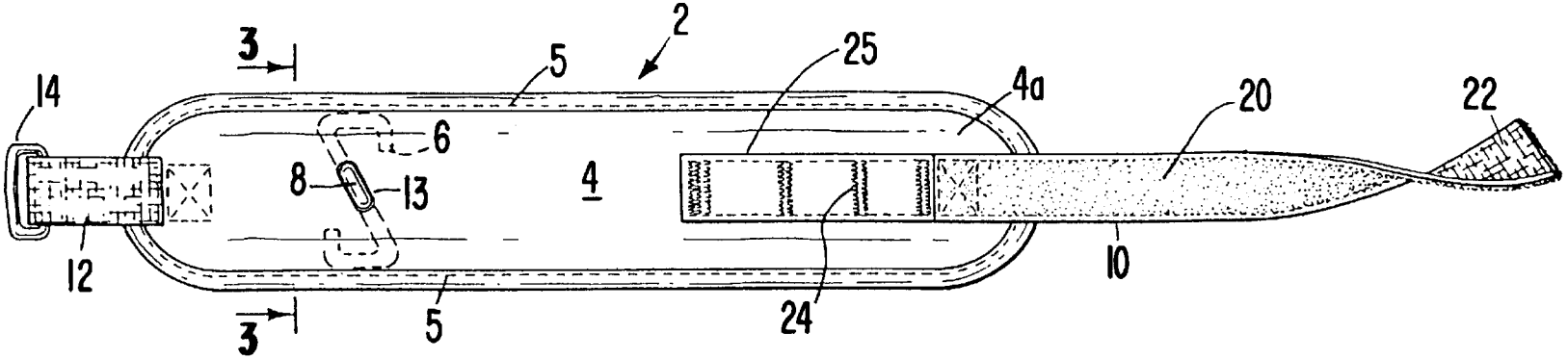
FIG. 2 shows a side view of the plan view of lift strap in accordance With the invention.
Figure 4:
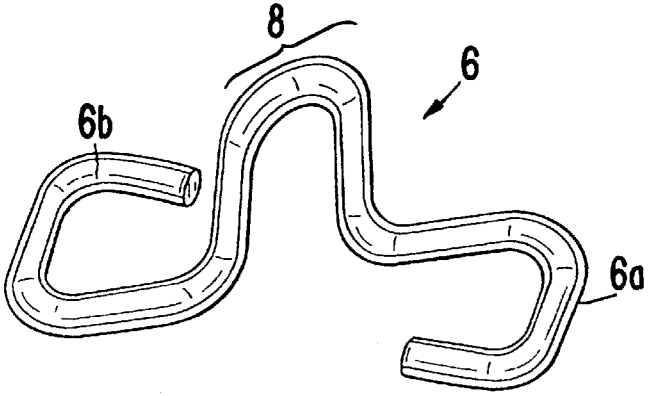
FIG. 4 shows a perspective view of a wire form used in the lift strap.
Figure 3:
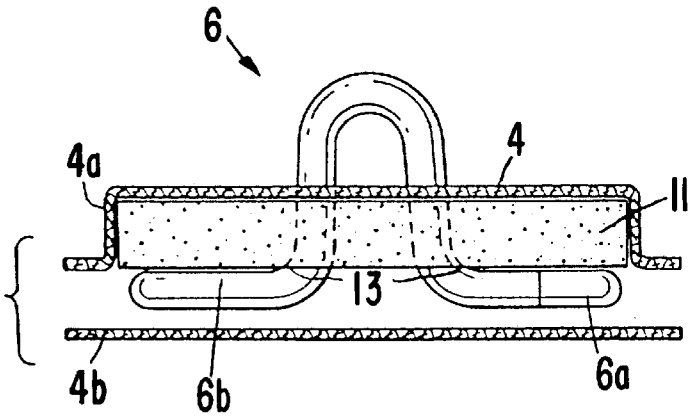
FIG. 3 shows a cross sectional view of the lift strap taken along lines 3—3 of FIG. 2.
Figure 5:
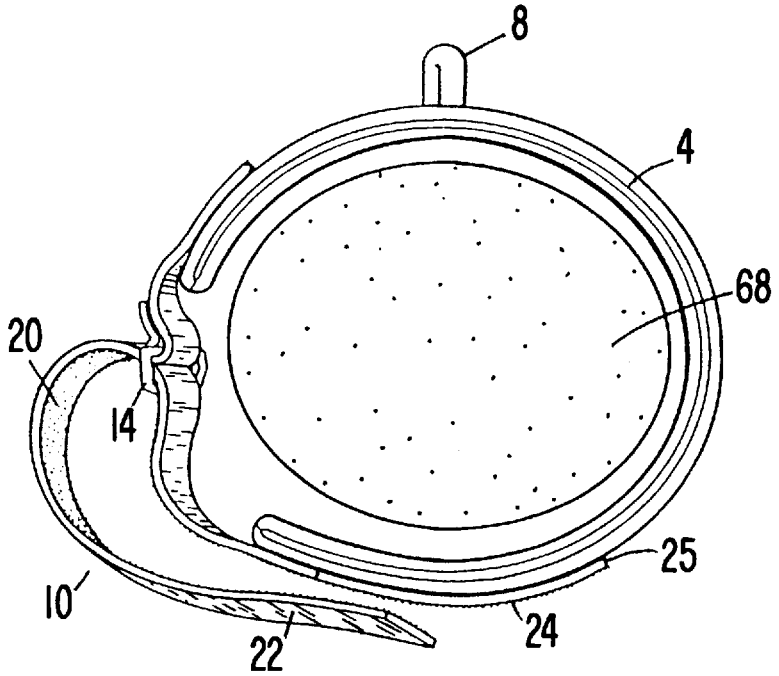
FIG. 5 illustrates the attachment of the lift strap to patients leg.

As illustrated in FIGS. 2–4, the lift strap 2 has a cover member 4. A wire form 6 of the shape shown in FIG. 4 is secured within the cover member 4 and has an eye member 8 extending exterior to the cover member 4 through a slit therein. The cover member 4 has a front surface 4*a* and a back surface 4*b* and serves to snugly cover a foam core 11, and for this purpose, stitching 5 is provided around the perimeter of the cover member 4 stitching together the front and back surfaces 4*a* and 4*b* with the foam core 1 inside. A slit 13 in the foam core 11 is provided to receive the eye member 8 of the wire form 6. Wire form 6 has arms 6*a* and 6b which present an extended surface and are thus too wide to pass through the slit 13 in the foam core 11. Thus, these arms 6*a* and 6*b* serve to secure the wire form 6 within the cover member 4. This construction is best seen in FIG. 3 which represents a side view of FIG. 2 taken along the lines 3—3 therein and showing the back surface 4*b* of the cover member 4 exploded to better reveal the arms 6*a* and 6*b*.

The cover member 4 with or without the enclosed foam core 11 comprises the main support member for the lift strap 2.

A first strap member 10 is attached to one end of the top surface 4*a* of cover member 4, and a second strap member 12 is attached to an opposite end of the top surface 4*a* of cover member 4. The straps may be attached to the cover member 4 by, for example, stitching. A loop 14 is secured to the strap 12. The first strap member 10 may be fabricated from a hook and loop material such as Velcro, and has a first mating surface 20 and a backing surface 22. The first strap member 10 (e.g., the first Velcro hook and loop strap) is largely free and only secured to the top surface 4*a* of cover member 4 at an end portion thereof.

A second mating surface 24 of a second Velcro hook and loop strap 25 is also provided which mates with the first mating surface 20 of the first strap member 20. The second Velcro hook and loop strap 25 is secured to the top surface 4*a* of the cover member 4 by, for example, stitching.

The wire form 6 may be made from one-quarter inch diameter stainless steel. The cover member 4 itself may be fabricated from 430 Denier nylon pack clothe. The foam core 11 may be one-quarter inch thick and comprise a 10 millimeter closed cell foam. Further, the loop 14 may be made of one and one-quarter inch plastic.

The lift strap has been tested and has a tensile strength of 429.9 lbs. for a single strap. Since the strap is used as a pair. And is intended for lifting only the lower portion of a patient, the above mentioned tensile strength is quite sufficient to handle a patient of any size.

In operation, a pair of straps such as the strap 2 illustrated in FIGS. 2–4 are utilized to lift only the lower portion of a patient's body. Each strap 2 is placed on the patient's leg above the knee while the patient is lying down in bed on his/her back. As seen in FIG. 1, the lifter 56 (for example, the Hoyer lifter) is then placed above the patient's knees and the patient is then attached to the lift swivel bar of the lifter 56 by using an S hook or a clothed hook generally provided on the lifter that will attach to the eye member 8 of the wire form 6. After a strap has been so placed on each leg of the patient, the patient can be lifted in a comfortable manner high enough for the caretaker to clean or change the patient.

Attachment of the strap to the patients leg is simple and straightforward. In reference to FIG. 5 which shows a patients leg 60 in section, the cover member 4 is wrapped around the patients leg and the distal end of the first strap member 10 is inserted through the loop 14 and wrapped back around the patient's leg so that the first mating surface 20 of the first strap member 10 (e.g., the first Velcro hook and loop strap) is matted to the second mating surface 24 of the second Velcro hook and loop strap 25. The mating surfaces 20 and 24 are sufficiently large in extent to permit the strap 2 to be secured to patients having many different sized girth dimensions and to permit the strap to be secured to the patient. It is noted that the strap need not be pulled too tight as to be uncomfortable, since the patient will generally be able to bend his/her legs (see FIG. 1) and thus prevent the strap from slipping beyond the patients knee when the patient is being lifted. Thus, the strap may be secured comfortably about the leg of the patient while still permitting the patient to be lifted safely.

The lifting forces exerted by the lifter 56 is transmitted to the arms 6*a* and 6*b* of the wire form 6 via the eye member 8. The foam core 11 and cover member 4 provide the counter force and thus the cover member 4 is easily lifted by the single care-giver operating the lifter 56. The lifter 56, of course, may be locked in place to enable to care-giver to freely use both hands to attend to the changing of the patients bedding and clothing. By raising only the lower portion (approximately the waist and below) of the patient the patient is never totally lifted from the bed 52 and thus is much more secure both psychologically and actually as compared with lifting techniques that lift the entire patient off of the bed.

Thus, a main purpose of the lift straps 2 is to lift the lower portion of the patient's body thereby allowing the care-giver the ability to clean the patient or change soiled clothing or bed lines. The care-giver will be able to do this without they themselves having to lift the patient, turn them over or require the assistance of another person in performing these tasks.

Modifications of the inventions may be readily apparent to those of skill in the art. For example, although not deemed to be as comfortable, a single large strap could be used to wrap around both legs of the patient and the single strap could be constructed essentially the same as described herein with the resulting method of lifting and caring for the patient being identical. Further, a single strap could be used on a single leg while no strap is used on the other leg. Such an arrangement would be appropriate, for example, if the patient had a leg amputated or injured. Additionally, the lift strap per se could be scaled up or down to be used around other portions of a patient body as a pure mechanism to assist in lifting a patient either manually or automatically. The ease of construction and on/off operation provide improvements over prior art lifting straps.

The first and second mating surfaces 20 and 24 composed of Velcro hook and loop surfaces may be replaced with other types of fastening arrangements as for example snap fasteners wherein the male (female) snap member is attached to the first strap member 10 and the female (male) snap member is attached to the second strap 25 or attached directly to the top surface 4*a* of the cover member 4. The snap members may be force fit metallic rings and/or magnetic elements (such as those commonly used to open/close ladies purses) and the like. Still further, the first strap member 10 could have a plurality of apertures therein, and the loop 14 could be in the form of a buckle having a pin member (similar to a belt buckle) which inserts into one of the plurality of apertures. Many types of hook and loop connections will be evident to those of skill in the art.

Generally, the cover member 4 is provided with a fastening device to hold the cover member in place around the leg of the patient, and the above described embodiments are exemplary of many different mechanisms which are effective for that purpose.

It is also evident that the eye member 8 as shown in FIG. 4 may take alternate forms while still achieving the purpose of providing a hook receiving mechanism for attachment to the lifter 56. For example, member 8 may be in the form of an open hook with arms 6*a* and 6*b* joined together by a separate connector positioned below the foam core 11. Thus, the eye member 8 may more generally be referred to as a hook receiving portion or device.

While the invention has been described with reference to the preferred embodiments of the invention, it is apparent that persons of skill in the art will appreciate various modifications of the preferred embodiments which do not depart from the scope of the invention as defined by the appended claims.

What is claimed is:

1. A method of lifting a bedridden person using a lifting device comprising the steps of:

a) securing a main support member to at least one leg of said person while said person is lying down on his/her back on a support surface;

b) securing said main support member to a lifting device; and c) using said lifting device to raise only the lower portion of said person from said support surface while permitting contact of the upper portion of said person with said bed, thereby permitting a care-giver to clean or change said person.

2. A method for lifting a bedridden person as recited in claim 1, wherein said step (a) includes the step of securing said main support member at a portion above the knee of said person and using said lifting device to lift said person while said person retains said at least one leg in a bent position at the knee to thereby prevent said main support member from sliding down below said knee.

3. A method of lifting a bedridden person as recited in claim 1, wherein step (a) includes securing a separate main support member to each leg of said person at a position above the knee.

4. A lift strap for attachment to a person desired to be lifted, said lift strap comprising:

a) a main support member, said main support member adapted to be secured around a portion of said person;

b) a hook receiving member secured to said main support member, said hook receiving member adapted to be connected to an external lifting device; and c) means, secured to said main support member, for securing said main support member to said portion of said person, said means comprising:

i) a first strap member secured to one end of said main support member; and ii) a loop member fixed to an opposite end of said main support member.

5. A lift strap as recited in claim 4 wherein said first strap comprises a self-securing mechanism.

6. A lift strap as recited in claim 5 wherein said first strap comprises a hook and loop fastener.

7. A lift strap for attachment to at least one leg of a person desired to be partially lifted from a prone position, said lift strap comprising:

a) a main support member, said main support member adapted to be secured around said at least one leg of said person;

b) a hook receiving member secured to said main support member, said hook receiving member adapted to be connected to an external lifting device; and c) a hook and loop mechanism, secured to said main support member, for securing said main support member to said at least one leg of said person, said hook and loop mechanism comprising:

i) a first strap member secured to one end of said main support member; and ii) a loop member fixed to an opposite end of said main support member.

* * * * *